US011076640B2

(12) United States Patent
Bjoerkholm

(10) Patent No.: US 11,076,640 B2
(45) Date of Patent: Aug. 3, 2021

(54) PRODUCT CONTAINER COMPRISING TRANSPARENT MEMBER

(71) Applicant: WINNINGTON AB, Hökerum (SE)

(72) Inventor: Lars Bjoerkholm, Vegby (SE)

(73) Assignee: WINNINGTON AB, Hokerum (SE)

( * ) Notice: Subject to any disclaimer, the term of this patent is extended or adjusted under 35 U.S.C. 154(b) by 60 days.

(21) Appl. No.: 16/327,123

(22) PCT Filed: Aug. 22, 2017

(86) PCT No.: PCT/EP2017/071163

§ 371 (c)(1),
(2) Date: Feb. 21, 2019

(87) PCT Pub. No.: WO2018/037019

PCT Pub. Date: Mar. 1, 2018

(65) Prior Publication Data

US 2019/0174822 A1 Jun. 13, 2019

(30) Foreign Application Priority Data

Aug. 23, 2016 (SE) ..... 1651130-5

(51) Int. Cl.

| | |
|---|---|
| ***A24F 23/00*** | (2006.01) |
| ***G09F 3/00*** | (2006.01) |
| *B65D 43/02* | (2006.01) |

(52) U.S. Cl.

CPC ..... *A24F 23/00* (2013.01); *G09F 3/00* (2013.01); *B65D 43/02* (2013.01); *B65D 2203/02* (2013.01)

(58) Field of Classification Search

CPC ..... A24F 23/00; A24F 23/02; A24F 23/04; A24F 15/18; G09F 3/00; B65D 43/02; B65D 2203/02; A47G 19/2227; A47G 19/2205

USPC ..... 206/236, 217; 215/11.1, 10, 6

See application file for complete search history.

(56) References Cited

U.S. PATENT DOCUMENTS 4,091,927 A 5/1978 Lunsford
4,165,815 A * 8/1979 Vetter ..... B65D 21/0228 15/244.1
6,196,412 B1 3/2001 Cattell
(Continued)

FOREIGN PATENT DOCUMENTS

EP 2161217 A1 3/2010
EP 2236433 A1 10/2010
(Continued)

OTHER PUBLICATIONS

Decision of grant for Russian Application No. 2019104943 dated Sep. 10, 2019, 12 pages.
(Continued)

*Primary Examiner* — King M Chu
(74) *Attorney, Agent, or Firm* — Patterson Thuente Pedersen, P.A.

(57) ABSTRACT

A product container for an oral consumer product including a first and second compartment. The compartments are divided from each other by a transparent member. The first compartment is adapted to host the oral consumer product and the second compartment is adapted to host the same oral consumer product after it has been consumed by a consumer.

14 Claims, 4 Drawing Sheets

(56) References Cited

U.S. PATENT DOCUMENTS

| | | | | |
|---|---|---|---|---|
| 7,798,319 | B1 * | 9/2010 | Bried | B65D 51/16 206/242 |
| 2003/0192894 | A1 | 10/2003 | Munns | |
| 2006/0016835 | A1 * | 1/2006 | Perry | B65D 1/32 222/494 |
| 2010/0089857 | A1 | 4/2010 | Dinerstein et al. | |
| 2011/0253729 | A1 * | 10/2011 | Ring | B65D 23/12 220/681 |
| 2013/0292279 | A1 * | 11/2013 | Bengtsson | D21H 17/68 206/245 |
| 2014/0262903 | A1 * | 9/2014 | Mitten | B65D 25/205 206/459.5 |

FOREIGN PATENT DOCUMENTS

| | | | |
|---|---|---|---|
| EP | 2767484 | A1 | 8/2014 |
| JP | 2008029554 | A | 2/2008 |
| RU | 2309728 | C2 | 11/2007 |
| WO | WO-2009098590 | A1 | 8/2009 |
| WO | WO-2011096257 | A1 | 8/2011 |

OTHER PUBLICATIONS

International Preliminary Report on Patentability for Application No. PCT/EP2017/071163, dated Jul. 24, 2018, 11 pages.
International Search Report and Written Opinion for Application No. PCT/EP2017/071163, dated Nov. 29, 2017, 14 pages.
Office Action dated Mar. 3, 2017 for Swedish Application No. SE1651130-5, 9 pages.

* cited by examiner

PRODUCT CONTAINER COMPRISING TRANSPARENT MEMBER

PRIORITY CLAIM

The present application is a National Phase entry of PCT Application No. PCT/EP2017/071163, filed Aug. 22, 2017, which claims priority from SE Patent Application No. 1651130-5, filed Aug. 23, 2016, which is hereby fully incorporated herein by reference.

TECHNICAL FIELD

The present disclosure relates generally to a product container for an oral consumer product wherein the product container comprises a transparent member.

BACKGROUND

In prior art it is known to provide information on the outside of product containers in order to communicate information to potential consumers and customers. It is further known to produce product containers of different shapes and sizes based on for example usage constraints relating to the product and how the container shall be stored. Such constraints decrease the options for manufacturers when designing product containers and it is for example important that many product containers fits in a normal pocket in order to fulfill customer requirements.

In addition, many areas of oral consumer products, such as tobacco and nicotine products are subject to increased amount of legislation as well as changes in the regulations regarding how to communicate the risks associated with such products to consumers. This has increased the amount of information required on the surface of the product containers without the market accepting that the containers grow in size. For the manufacturers this has resulted in decreased surface areas where the product can be described.

SUMMARY

Thus it would be beneficial to provide a product container that can present more information without increasing the size of the product container.

An object of the present disclosure is thereby to provide a product container, such as a snuff box or a chewing gum box, with an increased available surface area for customer information.

Another object of the present disclosure is to provide a product container that provides information at different stages of the product consuming process.

Another object of the present disclosure is to provide a product container enabling surfaces within the product container to be used for customer information without compromising the product. Thus it is a further object of the present disclosure to provide a product container that can arrange customer information within the product container without risking contact between the oral consumer product and a label, print, or other information carrier arranged inside a compartment of the product container.

Yet another object of the present disclosure is to provide a product container that increases the area for providing information to customers wherein the product container has dual compartments.

Thus, the present disclosure relates to a product container for an oral consumer product comprising a first and a second compartment. The compartments are divided from each other by a transparent member. An information carrier is arranged on the transparent member within the second compartment, and the information carrier has information on the side abutting the transparent member.

According to one embodiment the product container is a pocket-sized container.

It is one advantage with the present disclosure that the area for presenting customer information is increased without increasing the size of the product container. That has the effect that the product container for example can be maintained in a size that fits in the pocket of a user. This is achieved through enabling that the information can be viewed through the transparent member.

According to one embodiment the first compartment is adapted to host the oral consumer product and the second compartment is adapted to host the same oral consumer product after it has been consumed by a consumer. It shall be noted that consumed as used herein shall be interpreted as used by the consumer, for example a snuff portion that has been used by the consumer and thereafter removed from his/her mouth is considered consumed.

It is one advantage with the present disclosure that the first compartment may be used for storing an oral consumer product that is intended to be consumed by a user. The second compartment may be used to store already consumed products where the need for avoiding contact between the oral consumer product and the information is not present.

As described herein, an information carrier is arranged on the transparent member within the second compartment and the information carrier has information on the side abutting the transparent member.

According to one embodiment the information carrier has information on both sides.

It is one advantage with the present disclosure that the transparent member enables an information carrier to be viewed by a consumer from both the first and second compartments. The transparent member enables this through allowing the information carrier to be located outside of the compartment where the fresh product, such as snuff, smokeless tobacco, or chewing gum, is located. This is beneficial based on the basis that an oral consumer product that shall be consumed by a human shouldn't be in contact with information in order to avoid the risk for color or other substances being transferred to the unconsumed consumer product.

According to one embodiment the information carrier is a non-moisture absorbent label.

In one embodiment, the information carrier is moisture resistant, or non-moisture absorbent. The information carrier may for example be made from a plastic material such as polyethylene. Used oral consumer products are in general moist just after they have been consumed and it is beneficial if the product container will note be affected by the moisture in the oral consumer product when placed in the second compartment.

It is one advantage with the present disclosure that the information carrier may cover a greater surface area of the product container than for prior art solutions. This creates a solution wherein the material of the first compartment lid, second compartment lid, and main body together with the information carrier creates multiple layers enhancing the air tightness of the product container. This enhances the product container's ability to keep the product moist since less moisture can leave the product container. It is yet another advantage that the present invention is cost efficient in comparison with multilayer solutions for the material of the first compartment lid, second compartment lid, and main body.

According to one embodiment the information carrier has better air tightness properties than the first compartment lid, the second compartment lid, and the main body.

According to one embodiment the first compartment is arranged vertically above the second compartment.

According to one embodiment the product container is round or substantially round.

According to one embodiment the entire product container is made of a transparent material.

According to one embodiment the product container has the substantial form of a puck or low cylinder.

According to one embodiment the product container further comprises a main body, a first compartment lid, and a second compartment lid, wherein the second compartment lid is arranged on the opposite side of the main body than the first compartment lid.

According to one embodiment the main body, the first compartment lid, and the second compartment lid are all made from a plastic material.

According to one embodiment at least one of the main body, the first compartment lid, and the second compartment lid is made from a plastic material.

According to one embodiment at least one of the main body, the first compartment lid, and the second compartment lid is made from a metal material.

According to one embodiment the first compartment lid is adapted to cover the first compartment and the second compartment lid is adapted to cover the second compartment.

According to one embodiment the first compartment and second compartments are arranged on opposite sides of the product container.

According to one embodiment the first compartment lid is detachably attached to the main body and adapted to be released from the main body through a snap engagement.

According to one embodiment the first compartment lid has a snap engagement arranged on the outside of the main body and the second compartment lid has a snap engagement on the inside of the main body.

According to one embodiment the first compartment lid is attached to the main body with a bayonet mount.

According to one embodiment both the first and the second compartment lids are arranged to engage with the main body.

According to one embodiment the product container is coated with an UV resistant material.

According to one embodiment the product container is made from an UV resistant material.

Advantageously, the transparent sections, if located in a way that light can affect the oral consumer product, could be coated in a UV protective material in order to reduce the degradation of flavoring and other aspects of the oral consumer product.

According to one embodiment the first compartment is adapted to host an oral delivery product and the second compartment is adapted to host the same oral delivery product after it has been consumed by a consumer, wherein the compartments are divided from each other by a transparent member.

According to one embodiment the oral delivery product has been consumed when it has been used by a user once.

According to one embodiment the information carrier is an adhesive label with information on each side. The adhesive label is arranged in the second enclosed space on the transparent member and visible from the first enclosed space through the transparent member.

According to one embodiment the information carrier has information on both sides, one side visible from the first compartment and one side visible from the second compartment.

In such an embodiment, the information on one side of the information carrier may be visible through the transparent member from the first compartment and the information on the other side of the information carrier may be visible directly on the information carrier from the second compartment.

According to an embodiment the product container is a snuff box comprising a main body, a first compartment lid, and a second compartment lid. The main body comprises a transparent member arranged between said first and second compartments, an information carrier is arranged in the second compartment through adhesive to the transparent member such that information printed on a first side of the information carrier is visible from the first compartment and such that information printed on a second side of the information carrier is visible from the second compartment.

According to an embodiment the product container is a snuff box divided into two different compartments, a first compartment and a second compartment wherein the first compartment is a compartment adapted to store fresh snuff and said second compartment is adapted to store used snuff, wherein the first compartment is arranged on top of the second compartment with a transparent middle, i.e. a transparent member, in between the compartments, and wherein the upper compartment is the compartment adapted for fresh snuff. An information carrier, such as a label or sticker, is attached to the underside of the transparent member and visible through the bottom of the first compartment, i.e. the top of the second compartment, into the first compartment and downwards in the second compartment.

According to one embodiment the information carrier has information on its adhesive side.

According to one embodiment the information carrier has information on both sides, wherein one side is adhesive.

According to one embodiment the product container for an oral consumer product is a snuff box.

According to one aspect, there is provided a method for producing a product container for an oral consumer product wherein said product container comprises a first compartment adapted to host the oral consumer product and a second compartment adapted to host the same oral consumer product after it has been consumed by a consumer, the method comprising arranging an information carrier on a transparent member such that said information carrier is visible both from the first and the second compartment of the product container.

According to one embodiment for producing a product container, said information carrier is a label arranged in the second compartment avoiding contact with the non-consumed oral consumer product.

According to one embodiment for producing a product container, the production further comprises coating the product container with an UV resistant material.

According to one embodiment for producing a product container, the product container is a snuff box.

BRIEF DESCRIPTION OF DRAWINGS

The disclosure is now described, by way of example, with reference to the accompanying drawings, in which.

DESCRIPTION OF EMBODIMENTS

In the following, a detailed description of the different embodiments of the disclosure is disclosed under reference to the accompanying drawings. All examples herein should be seen as part of the general description and are therefore possible to combine in any way of general terms. Individual features of the various embodiments and aspects may be combined or exchanged unless such combination or exchange is clearly contradictory to the overall function of the product container.

Briefly described, the disclosure relates to a product container adapted to hold an oral consumer product such as snuff, any oral smokeless tobacco, chewing gum, or any other suitable oral consumer product. The product container has a new and inventive construction that increases the available area for consumer information without compromising the size of the product container.

Figure 1A:
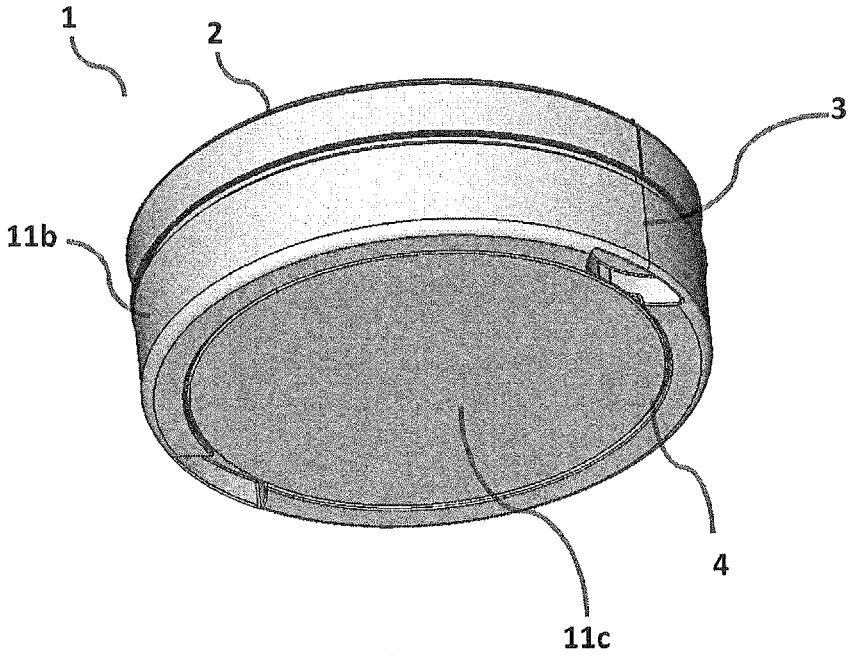
FIG. 1*a* illustrates one embodiment of a product container from a first view.

FIG. 1*a* illustrates an isometric view of one embodiment of a product container 1 comprising a first compartment lid 2, a main body 3, and a second compartment lid 4. The product container 1 further has a number of surfaces 11*b*, 11*c* which can be populated with information for customers. FIG. 1*a* further illustrates one embodiment of how the product container 1 is constructed wherein the first compartment lid 2 covers a first compartment 10*a* which is adapted to store an oral consumer product. The second compartment lid 4 is adapted to cover a second compartment 10*b* that is adapted to host a consumed oral consumer product, such as a used snuff portion or a used chewing gum. An oral consumer product is any form of product adapted to be consumed by a human through oral delivery, such as snuff, chewing tobacco, chewing gum, or any other form of oral consumer product.

Figure 1B:
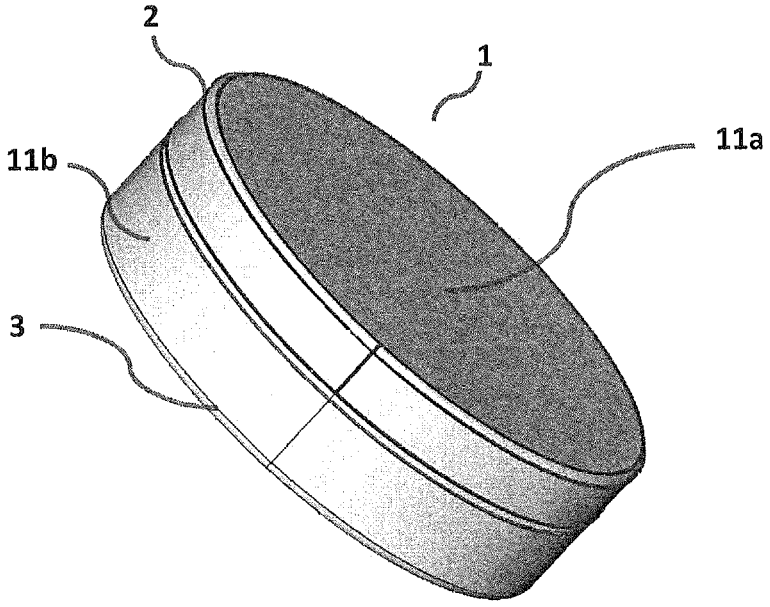
FIG. 1*b* illustrates one embodiment of a product container from a second view.

FIG. 1*b* illustrates another isometric view of one embodiment of a product container 1 comprising a first compartment lid 2, a main body 3, and a second compartment lid (not visible in FIG. 2). FIG. 1*b* also illustrates surfaces 11*a*, 11*b* whereon customer information can be arranged.

Figure 2A:
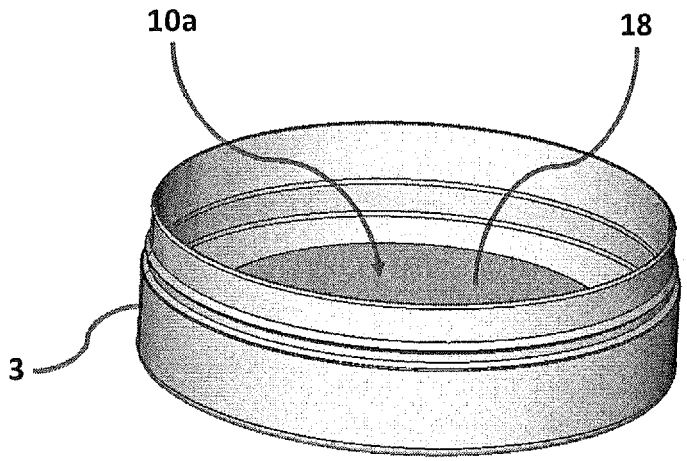
FIG. 2*a* illustrates one embodiment of the main body from a view wherein the first compartment and the transparent member are visible.

FIG. 2*a* illustrates an open main body 3 of a product container wherein the first compartment lid 2 has been removed. The main body comprises a first compartment 10*a* with a transparent member 18. The transparent member 18 can be any form of transparent member, such as a surface, a wall, a membrane, piece of glass, or any other transparent member arranged as a member of the first compartment. It shall be noted that in different embodiments the first compartment 10*a* can be arranged in different ways in relation to the main body 3 and that the construction comprising a main body 3 is not a limitation to the scope of the disclosure. The transparent member 18 is either a part of the main body 3, a separate member, or a separate member arranged in fixed connection with the main body 3.

Figure 2B:
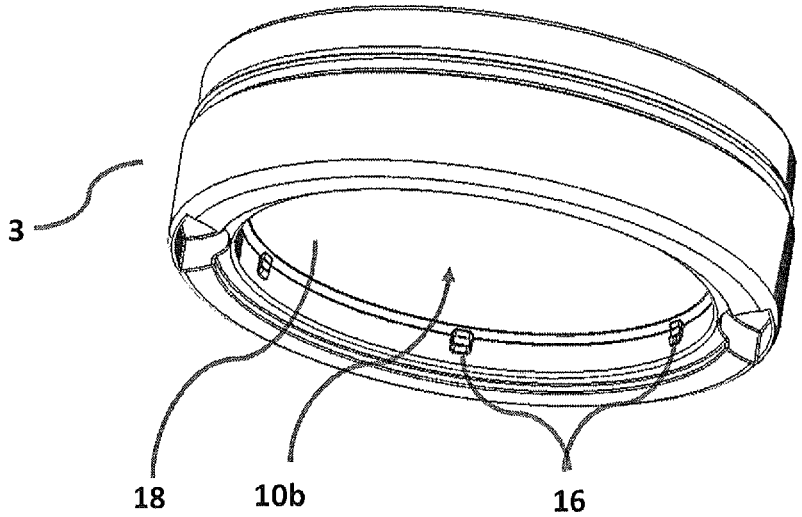
FIG. 2*b* illustrates one embodiment of the main body from a view wherein the second compartment and the transparent member are visible.

FIG. 2*b* illustrates another view of an open main body 3 wherein it is shown that also the second compartment lid 4 has been removed from the main body 3 of the product container 1. FIG. 2*b* further illustrates the other side of the transparent member 18 as seen in FIG. 2*a*. From FIG. 2*b* the second compartment 10*b* is also visible and it is shown how the transparent member 18 delimits the second compartment 10*b* in a similar fashion as it delimits the first compartment 10*a*. It shall be noted from FIG. 2*a* and FIG. 2*b* that the transparent member has one surface towards the first compartment 10*a* and one surface towards the second compartment 10*b*.

FIG. 2*b* further illustrates attaching means 16 for the second compartment lid 6. The attachment means 16 can for example be means adapted for a screw or snap engagement.

Figure 3A:
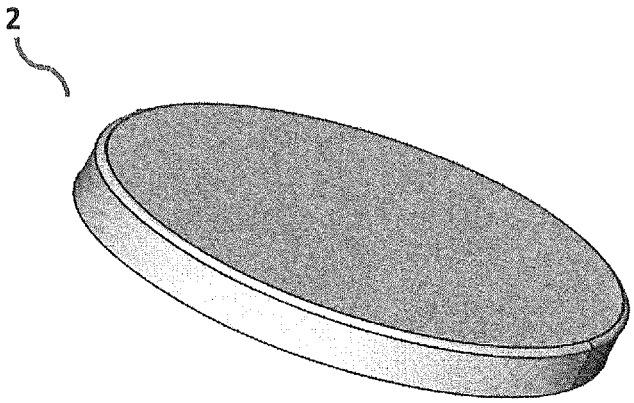
FIG. 3*a* illustrates one embodiment of the first compartment lid.
Figure 3B:
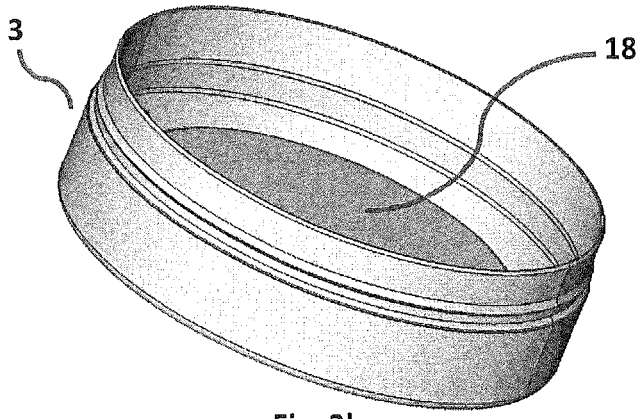
FIG. 3*b* illustrates one embodiment of the main body.
Figure 3C:
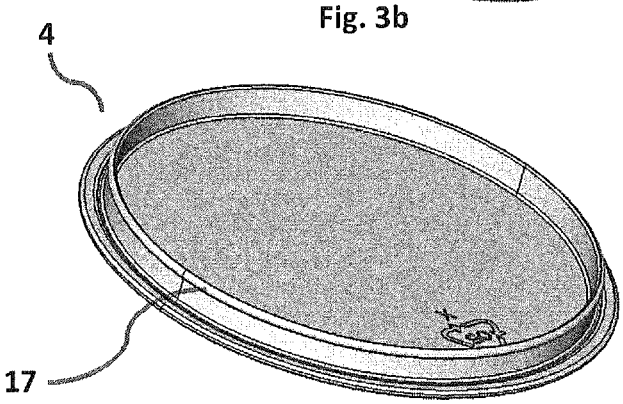
FIG. 3*c* illustrates one embodiment of the second compartment lid.

FIGS. 3*a*, 3*b*, and 3*c* illustrates a dissembled view of the product container. According to one embodiment the first compartment lid 2 and the second compartment 4 lid attaches to different sides of the main body 3 as illustrated in FIGS. 3*a*, 3*b*, and 3*c*.

FIG. 3*a* illustrates the first compartment lid 2 which in different embodiments of the disclosure can have different sizes and forms. However, it shall be noted that the product container 1 in one embodiment is adapted to be stored in a user's pocket. In one embodiment the product container 1 further is adapted to fit in the palm of a user's hand.

FIG. 3*b* illustrates the main body 3 of a product container 1 according to one embodiment of the disclosure. FIG. 3*b* further illustrates the transparent member 18 here arranged in the bottom of the first compartment 10*a*.

FIG. 3*c* illustrates one embodiment of the second compartment lid 4 comprising a ridge 17 adapted to interact with the attachment means 16, as illustrated in FIG. 2*b*, to bring the second compartment lid 4 into engagement with the main body 3.

Figure 4A:
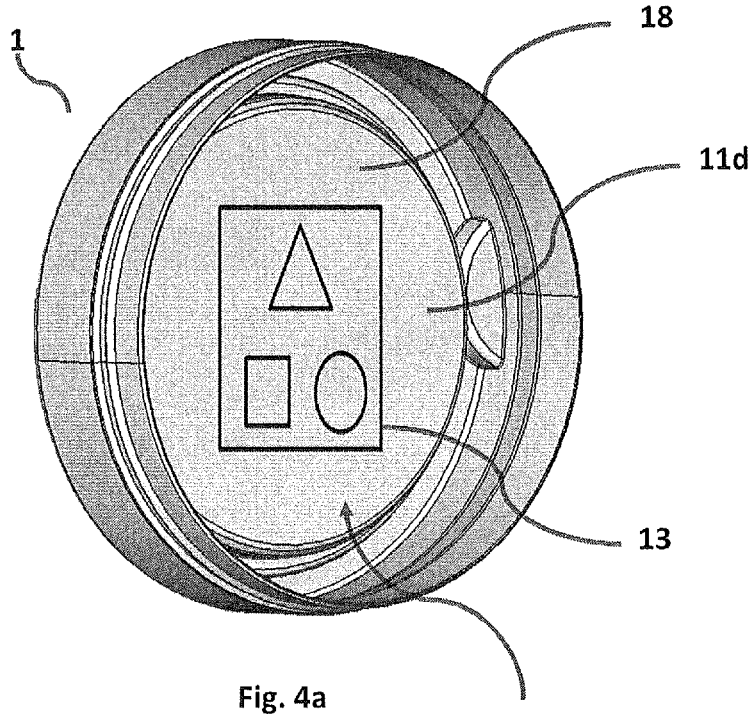
FIG. 4*a* illustrates one embodiment of the main body from a view where the first compartment and the transparent member is visible, wherein information is visible through the transparent member.

FIG. 4*a* illustrates one embodiment of a view of the main body 3 with a first compartment 10*a* and a transparent member 18. A potential surface for presenting information is further shown and marked with 11*d*. It shall be noted that it normally is not allowed to present information via any form of label, printed information, or other form of information within a compartment where oral consumer products are stored. Thereby the surface 11*d* is not utilizable in the common product container. However, as illustrated in FIG. 4*a* the information 13 is clearly visible through the transparent member 18 and thereby visible in the first compartment 10*a*. The person skilled in the art understands that the information 13 can be any form of information including but not limited to printed information and consumer information.

Figure 4B:
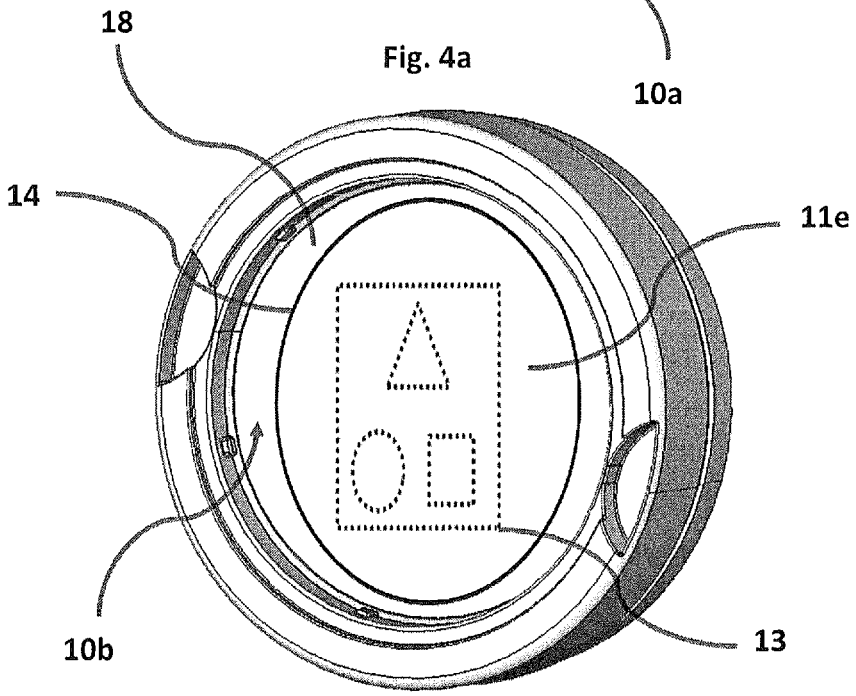
FIG. 4*b* illustrates one embodiment of the main body from a view where the second compartment and the transparent member is visible, wherein an information carrier is arranged on the transparent member showing information towards the first compartment through the transparent member.

FIG. 4*b* illustrates an embodiment wherein the second compartment 10*b* is arranged in the main body and the transparent member 18 that divides the first 10*a* and second 10*b* compartments is clearly visible. On the transparent member 18 has an information carrier 14 been arranged, the information carrier 14 can be any form of information carrier such as a sticker, a label, printed information, information printed directly on a surface such as the transparent member, or any other form of suitable information carrier 14. The information carrier 14 as illustrated in FIG. 4*b* has no information 13 on the side facing the second compartment 11*b*. However, in one embodiment can the surface 11*e* be utilized to present information through presenting information on both sides of the information carrier 14. As illustrated in FIG. 4*b* the information 13 is printed on the back of the information carrier 14, facing the transparent member 18, and thereby visible only from the first compartment 10*a* located on the other side of the transparent member 18.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of appropriate combinations of the disclosed elements, components, features, parts, steps, means, etc., other than those specifically described herein. In addition, this disclosure may include other inventions not presently claimed, but which may be claimed in the future.

Further aspects of the disclosure are described in the following paragraphs:

1. A product container for an oral consumer product comprising a first and a second compartment, wherein said compartments are divided from each other by a transparent member.
2. The product container according to paragraph 1, wherein the first compartment is adapted to host the oral consumer product and the second compartment is adapted to host the same oral consumer product after it has been consumed by a consumer.
3. The product container according to any one of paragraphs 1 or 2, wherein an information carrier is arranged on the transparent member within the second compartment and the information carrier has information on the side abutting the transparent member.
4. The product container according to paragraph 3, wherein the information carrier is a non-moisture absorbent label.
5. The product container according to any one of paragraphs 1-4, wherein the first compartment is arranged vertically above the second compartment.
6. The product container according to any one of paragraphs 1-5, wherein the entire product container is made of a transparent material.
7. The product container according to any one of paragraphs 1-6, wherein the product container further comprises a main body, a first compartment lid, and a second compartment lid, wherein the second compartment lid is arranged on the opposite side of the main body than the first component lid.
8. The product container according to paragraph 7, wherein the first compartment lid is adapted to cover the first compartment and the second compartment lid is adapted to cover the second compartment.
9. The product container according to any one of paragraphs 7 and 8, wherein said first compartment lid and said second compartment lid are detachably attached to the main body.
10. The product container according to any one of paragraphs 1-9, wherein the product container is coated with or made of an UV resistant material.
11. The product container according to any one of paragraphs 1-10, wherein said product container for an oral consumer product is a snuff box.
12. A method for producing a product container for an oral consumer product wherein said product container comprises a first compartment adapted to host the oral consumer product and a second compartment adapted to host the same oral consumer product after it has been consumed by a consumer, the method comprising arranging an information carrier on a transparent member such that said carrier is visible both from the first and the second compartment of the product container.
13. The method for producing a product container according to paragraph 12, wherein said information carrier is a label arranged in the second compartment avoiding contact with the non-consumed oral consumer product.
14. The method for producing a product container, according to any one of paragraphs 12-13, wherein the method further comprises coating the product container with an UV resistant material.
15. The method for producing a product container according to any one of paragraphs 12-14, wherein the product container is a snuff box.

Various modifications and variations of the present invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

The invention claimed is:

1. A product container for an oral consumer product comprising:

a main body;

a first compartment within the main body and having a first compartment opening;

a first compartment lid positionable on the main body to cover the first compartment opening; and a second compartment within the main body, wherein the first compartment and the second compartment are divided from each other by a transparent member, wherein an information carrier is arranged on the transparent member within the second compartment and the information carrier has information on a side abutting the transparent member, the information carrier being arranged on the transparent member such that the side abutting the transparent member faces the first compartment opening so that the information on the side is visible through the first compartment opening when the first compartment lid is removed.

2. The product container according to claim 1, wherein the first compartment is adapted to host the oral consumer product and the second compartment is adapted to host the same oral consumer product after the oral consumer product has been consumed by a consumer.

3. The product container according to claim 1, wherein the information carrier is a non-moisture absorbent label.

4. The product container according to claim 1, wherein the first compartment is arranged vertically above the second compartment.

5. The product container according to claim 1, wherein the entire product container is made of a transparent material.

6. The product container according to claim 1, further comprising a second compartment lid, wherein the second compartment lid is arranged on an opposite side of the main body than the first compartment lid.

7. The product container according to claim 6, wherein the second compartment lid is adapted to cover the second compartment.

8. The product container according to claim 6, wherein the first compartment lid and the second compartment lid are detachably attached to the main body.

9. The product container according to claim 1, wherein the product container is coated with or made of an UV resistant material.

10. The product container according to claim 1, wherein the product container for an oral consumer product is a snuff box.

11. A method for producing a product container for an oral consumer product wherein the product container comprises a main body, a first compartment within the main body and having a first compartment opening, the first compartment being adapted to host the oral consumer product, and a second compartment within the main body adapted to host the same oral consumer product after the oral consumer product has been consumed by a consumer, the method comprising:

arranging an information carrier on a transparent member within the second compartment such that information on a side abutting the transparent member faces the first compartment opening so that the information on the side is visible through the first compartment opening and the transparent member when the first compartment lid is removed.

12. The method for producing the product container according to claim 11, wherein the information carrier is a label arranged in the second compartment avoiding contact with the non-consumed oral consumer product.

13. The method for producing the product container according to claim 11, wherein the method further comprises coating the product container with an UV resistant material.

14. The method for producing the product container according to claim 11, wherein the product container is a snuff box.

* * * * *